US011214430B2

(12) United States Patent
Baek

(10) Patent No.: US 11,214,430 B2
(45) Date of Patent: Jan. 4, 2022

(54) HOLDING DEVICE FOR SPRAY CONTAINER

(71) Applicant: Jung Youl Baek, Los Angeles, CA (US)

(72) Inventor: Jung Youl Baek, Los Angeles, CA (US)

( * ) Notice: Subject to any disclaimer, the term of this patent is extended or adjusted under 35 U.S.C. 154(b) by 0 days.

(21) Appl. No.: 17/197,366

(22) Filed: Mar. 10, 2021

(65) Prior Publication Data

US 2021/0198029 A1 Jul. 1, 2021

Related U.S. Application Data

(63) Continuation-in-part of application No. 16/501,467, filed on Mar. 11, 2019, now Pat. No. 10,994,296.

(51) Int. Cl.

| | |
|---|---|
| ***B65D 83/24*** | (2006.01) |
| ***B65D 83/20*** | (2006.01) |
| *B05B 9/08* | (2006.01) |
| *B05B 12/00* | (2018.01) |

(52) U.S. Cl.

CPC ..... *B65D 83/24* (2013.01); *B65D 83/201* (2013.01); *B05B 9/0883* (2013.01); *B05B 12/0024* (2018.08)

(58) Field of Classification Search

CPC .... B65D 83/24; B65D 83/201; B05B 9/0883; B05B 12/0024

See application file for complete search history.

(56) References Cited

U.S. PATENT DOCUMENTS

| | | | | |
|---|---|---|---|---|
| 3,178,077 A * | 4/1965 | Benedetto | B65D 83/206 222/402.13 |
| 6,062,432 A * | 5/2000 | Estrada | B65D 83/206 222/153.12 |
| 6,126,044 A * | 10/2000 | Smith | B65D 83/206 222/1 |
| 2002/0020722 A1* | 2/2002 | Uemura | B65D 83/24 222/402.13 |
| 2008/0308583 A1* | 12/2008 | Matsuyama | B65D 83/24 222/402.14 |

* cited by examiner

*Primary Examiner* — Donnell A Long

(74) *Attorney, Agent, or Firm* — Heedong Chae; Lucem, PC

(57) ABSTRACT

A holding device for a spray container that includes a body, a nozzle portion on a top of the body, and a groove formed between the body and the nozzle portion, the holding device including a base, which is constructed to be placed on a top of the body around the nozzle portion; a pressing part that is connected to a first portion of the base and extends over the nozzle portion, wherein an end of the pressing part includes a first interlocking part; and a first supporting bar which is connected to a second portion of the base, wherein a second interlocking part is formed on or about a top of the first supporting bar and a first protrusion is inwardly formed on or about a bottom of the first supporting bar to detachably couple with the groove.

20 Claims, 14 Drawing Sheets

HOLDING DEVICE FOR SPRAY CONTAINER

CROSS-REFERENCE TO RELATED APPLICATIONS

This application is a continuation-in-part of and claims priority to U.S. patent application Ser. No. 16/501,467, filed on Mar. 11, 2019, the disclosure of which is incorporated herein in its entirety by reference.

FIELD OF THE INVENTION

The present invention pertains generally to the field of dispensing, and more particularly to a holding device adapted to use with a fluid dispenser to maintain the dispenser in an open or closed state.

BACKGROUND OF THE INVENTION

A sprayer containing fluid under pressure, such as a spray can, releases an aerosol mist of liquid particles by pressing a push button of the sprayer. This spray-type container is used in various fields such as painting, coating, gardening, vector control (e.g. insect repellant), lubrication, waterproofing, etc. In the field of painting, this spray-type container enables an operator to apply large volumes of paint fluid rapidly with substantial control over the fineness and density of the spray mist. In addition, this spray-type container can store the rest of the contents for future dispensing over prolonged periods of time. Furthermore, such spray-type containers are amenable to stored or stacked together in large numbers.

However, with regards to their operation, it is difficult for a user to maintain a continuous or constant pressure by his finger on the push button for any great length of time due to fatigue. This fatigue may lead loss of fine control over the dispensing of the stored fluid, which may reduce the fineness of its application. Furthermore, other securing devices only be big, heavy, or complicated structures, which may lead to difficulty in their use and cause high manufacturing costs, the latter of which may be passed on to consumers.

Therefore, to overcome the above problems, various embodiments of a holding device for spray containers are provided, as there is a need for a holding device that accomplishes the goals of being convenient, easy to use, and inexpensive to manufacture. This invention is directed to solve these problems and satisfy the long-felt need.

SUMMARY OF THE INVENTION

The present invention contrives to solve the disadvantages of the prior art by providing a holding device for a spray container that permits the spray container to maintain a continuous release without a constant force or intervention from the user.

The object of the invention is to provide a holding device for a spray container including a body and a push button on a top of the body, the holding device comprising: a supporting part which is placed around the push button; an adjusting part having a pillar-shaped portion standing on the supporting part, and a diving board-shaped portion connected to the pillar-shaped portion and extending over a top of the push button, on a top of the diving board-shaped portion having a recess; and an auxiliary part being pillar-shaped and standing on the supporting part, having a protrusion toward the adjusting part to be engaged with the recess.

Another object of the invention is to provide a holding device for a spray container including a body, a push button on a top of the body, and a coupling ring connecting between the body and the push button, the holding device comprising: a supporting part being loop-shaped, which is placed on a top of the body and within the perimeter of the top of the body around the push button; an adjusting part having pillar-shaped portion standing on the supporting part, and a diving board-shaped portion connected to the pillar-shaped portion and extending over a top of the push button, having a first interlocking part; and an auxiliary part being pillar-shaped and standing on the supporting part, having a second interlocking part to be engaged with the first interlocking part, wherein a width of the holding device is equal to or lesser than that of the body in a direction perpendicular to the push button pressed.

Yet another object of the invention is to provide a holding device for a spray container which includes a body, a push button on a top of the body, and a coupling ring connecting between the body and the push button, the holding device comprising: a supporting part being loop-shaped, which is placed on a top of the body around the push button, having at least one inward protrusion on the bottom to be engaged with a groove formed between the body and the coupling ring; an adjusting part having a pillar-shaped portion standing on the supporting part, and a diving board-shaped portion connected to the pillar-shaped portion and extending over a top of the push button, having a first interlocking part; and an auxiliary part being pillar-shaped and standing on the supporting part, having a second interlocking part to be engaged with the first interlocking part.

Yet another object of the invention is to provide a holding device for a spray container which includes a body, a push button on a top of the body, a coupling ring, and a groove formed between the body and the coupling ring, the holding device comprising: a supporting part which is placed around the push button, the supporting part including a plurality of inward protrusions; an adjusting part which includes a pillar-shaped portion standing on the supporting part, and a diving board-shaped portion connected to the pillar-shaped portion and extending over a top of the push button, on a top of the diving board-shaped portion having a first interlocking part; and an auxiliary part which includes a pillar-shaped portion connected to the supporting part, an adjustment arm which protrudes toward an outside of the supporting part, and a second interlocking part to be engaged with the first interlocking part.

Yet another object of the invention is to provide a holding device for a spray container including a body, a push button on a top of the body, a coupling ring, and a groove formed between the body and the coupling ring, said holding device comprising: a supporting part being loop-shaped, which is placed on a top of the body and within the perimeter of the top of the body around the push button; an adjusting part including a pillar-shaped portion standing on the supporting part, and a diving board-shaped portion connected to the pillar-shaped portion and extending over a top of the push button, having a first interlocking part; and an auxiliary part including a pillar-shaped portion connected to the supporting part, and a second interlocking part to be engaged with the first interlocking part. A width of the holding device is equal to or less than that of the body in a direction perpendicular to the push button pressed.

Yet another object of the invention is to provide a holding device for a spray container including a body, a push button on a top of the body, a coupling ring, and a groove formed between the body and the coupling ring, said device comprising: a supporting part being loop-shaped, which is placed on a top of the body around the push button, having at least one inward protrusion on the bottom to be engaged with the groove; an adjusting part having a pillar-shaped portion standing on the supporting part, and a diving board-shaped portion connected to the pillar-shaped portion and extending over a top of the push button, having a first interlocking part; an auxiliary part including a pillar-shaped portion connected to the supporting part, and a second interlocking part to be engaged with the first interlocking part.

The supporting part includes a plurality of inward protrusions. The inward protrusions project towards a center of the holding device. Further, the inward protrusions are constructed to detachably couple with the groove. Further, the inward protrusions are interspaced from each other. A first end of the pillar-shaped portion lies above the supporting part. A second end of the pillar-shaped portion of the auxiliary part lies below an area where the pillar-shaped portion of the auxiliary part and the supporting part meet. At least one of the inward protrusions is joined to the second end of the pillar-shaped portion of the auxiliary part.

Yet another object of the invention is to provide a holding device for a spray container which includes a body, a nozzle portion on a top of the body, and a groove formed between the body and the nozzle portion, the holding device comprising: a base, which is constructed to be placed on a top of the body around the nozzle portion; a pressing part that is connected to a first portion of the base and extends over the nozzle portion, wherein an end of the pressing part includes a first interlocking part; and a first supporting bar which is connected to a second portion of the base, wherein a second interlocking part is formed on or about a top of the first supporting bar and a first protrusion is inwardly formed on or about a bottom of the first supporting bar to detachably couple with the groove. The first interlocking part is constructed to be engaged with the second interlocking part by downwardly moving the pressing part. Further, the first interlocking part is constructed to be disengaged from the second interlocking part by outwardly moving the first supporting bar. Further, the first protrusion is constructed to be disengaged from the groove by inwardly moving the first supporting bar.

Yet another object of the present invention is to provide a holding device for a spray container which includes a body, a nozzle portion on a top of the body, and a groove formed between the body and the nozzle portion, the holding device comprising: a base, which is constructed to be placed on a top of the body around the nozzle portion; a pressing part that is connected to a first portion of the base and extends over the nozzle portion, wherein an end of the pressing part includes a first interlocking part; a first supporting bar which is connected to a second portion of the base, wherein a second interlocking part is inwardly formed on or about a top of the first supporting bar; a tab that is outwardly formed on or about the top of the first supporting bar; and a first protrusion inwardly formed to detachably couple with the groove.

The first interlocking part is constructed to be engaged with the second interlocking part by downwardly moving the pressing part. Further, the first interlocking part is constructed to be disengaged from the second interlocking part by downwardly moving the tab. Further, the first protrusion is constructed to be disengaged from the groove by upwardly or inwardly moving the tab.

Yet another object of the present invention is to provide a holding device for a spray container which includes a body, a nozzle portion on a top of the body, and a groove formed between the body and the nozzle portion, the holding device comprising: a base, which is constructed to be placed on a top of the body around the nozzle portion; a pressing part that is connected to a first portion of the base and extends over the nozzle portion, wherein an end of the pressing part includes a first interlocking part; a first supporting bar which is connected to a second portion of the base, wherein a second interlocking part is formed on or about a top of the first supporting bar; and a first protrusion inwardly formed to detachably couple with the groove.

Bottom cuts are formed on the base and on both sides of the first supporting bar and the bottom cuts are upwardly formed from a bottom edge of the base. The first interlocking part is constructed to be engaged with the second interlocking part by downwardly moving the pressing part. Further, the first interlocking part is constructed to be disengaged from the second interlocking part by outwardly moving the first supporting bar. Further, the first protrusion is constructed to be disengaged from the groove by inwardly moving the first supporting bar.

The advantages provided by various embodiments of the present invention include: (1) a small and light construction, thus allowing the holding device to be easily transported; (2) the small and light construction further provides cost savings in the production/manufacturing of the holding device; (3) bottom and top cuts permits the user pivot, at least slightly, a part of the holding device to easily allow the holding device to engage with and disengage from the spray container; (4) multiple shape profiles for the protrusions of the holding device that improve ease and usability of securing the holding device to and removing the holding device from the spray container (e.g. the convex shape of the first protrusion permits the holding device to easily attach to and detach from the spray container); (5) an interlocking mechanism featured in the holding device that engages the nozzle of the spray container, thus preventing user fatigue in operating the spray container; (6) the small size of the holding device allows it to occupy a minimal amount of space; (7) anti-slip means on the pressing part and the first supporting bar to provide greater control over the functioning of the holding device when detachably engaged with the spray container so that the dispensing of the contents from the spray container is easily controlled for even application of the contents to a target object; and (8) an extension part that increases the height of the protrusion, thus increasing the range of spray containers that the holding device can be used on.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTIONS

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as form "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
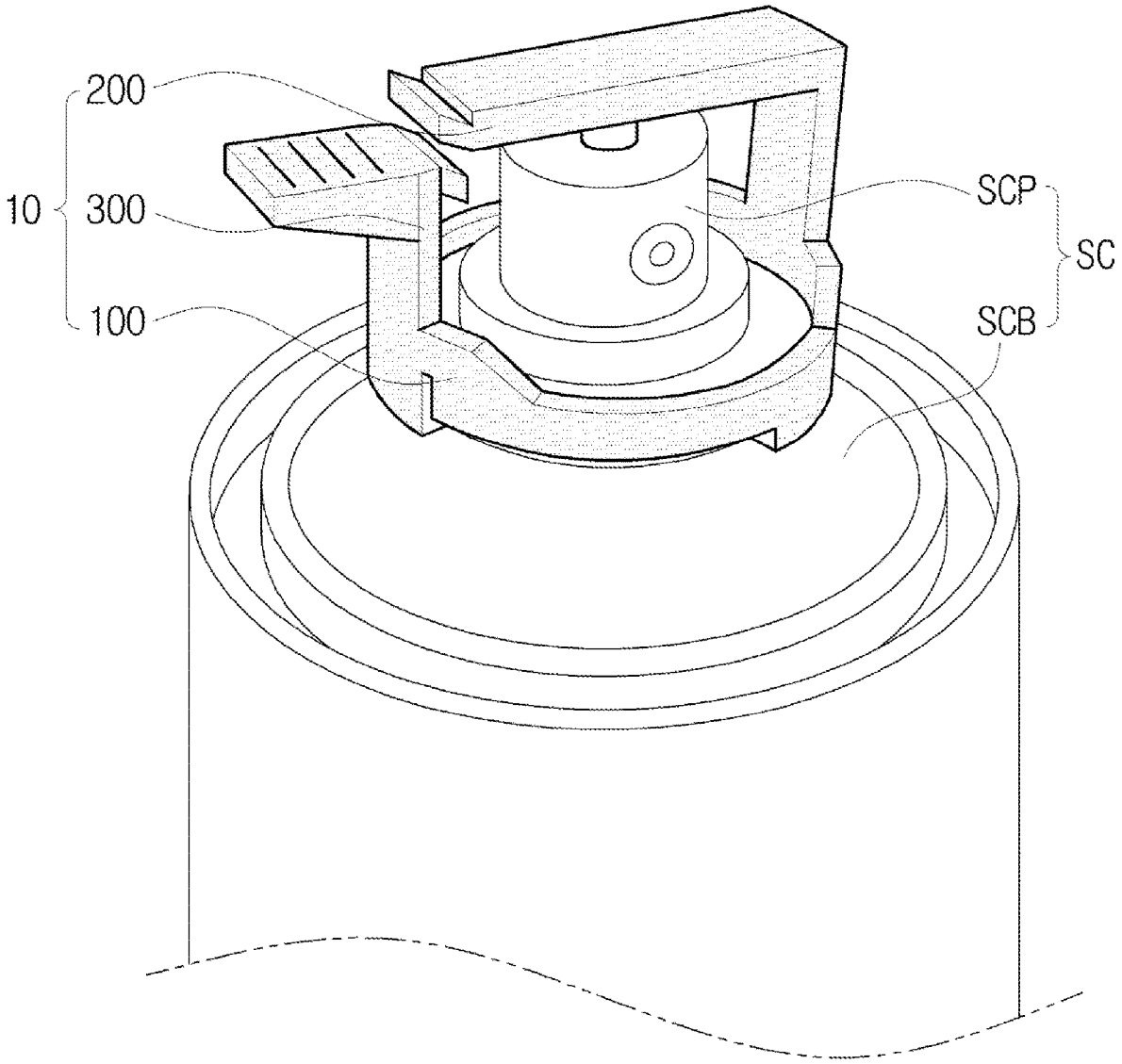
FIG. 1 shows a perspective view of a holding device mounted on a spray container according to various embodiments of the present invention.

FIG. 1 shows a perspective view of a holding device 10 mounted on a spray container SC according to one embodiment of the present invention. According to FIG. 1, a holding device 10 is mounted on a top of body SCB of a spray container SC around a push button SCP. The spray container SC may contain fluid in a body SCB under pressure and release the fluid by pressing a push button SCP equipped with the body SCB. The spray container SC may be a paint sprayer containing paint but not limited to. The spray container SC may be any commercial standard spray containers.

The holding device 10 includes a supporting part 100, an adjusting part 200, and an auxiliary part 300. The supporting part 100, an adjusting part 200, and an auxiliary part 300 may be connected to each other indivisibly in one body. Further, The supporting part 100, an adjusting part 200, and an auxiliary part 300 may be made of the same material such as plastic but not limited to. According to the present invention, the holding device 10 may have a simple structure and one material, which can offer reduced cost of manufacture.

Figure 2:
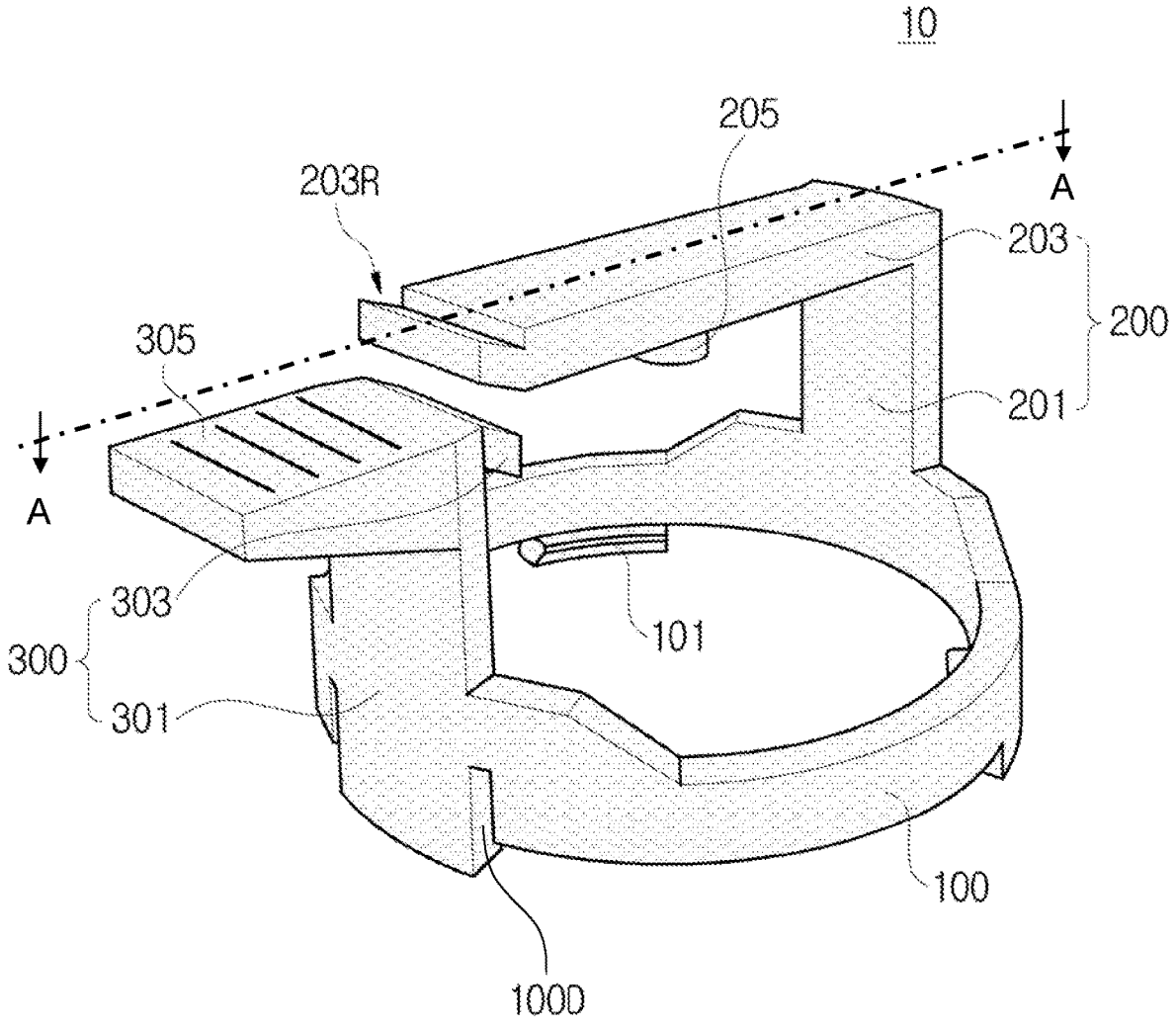
FIG. 2 shows a perspective view from above of the holding device of FIG. 1.
Figure 3:
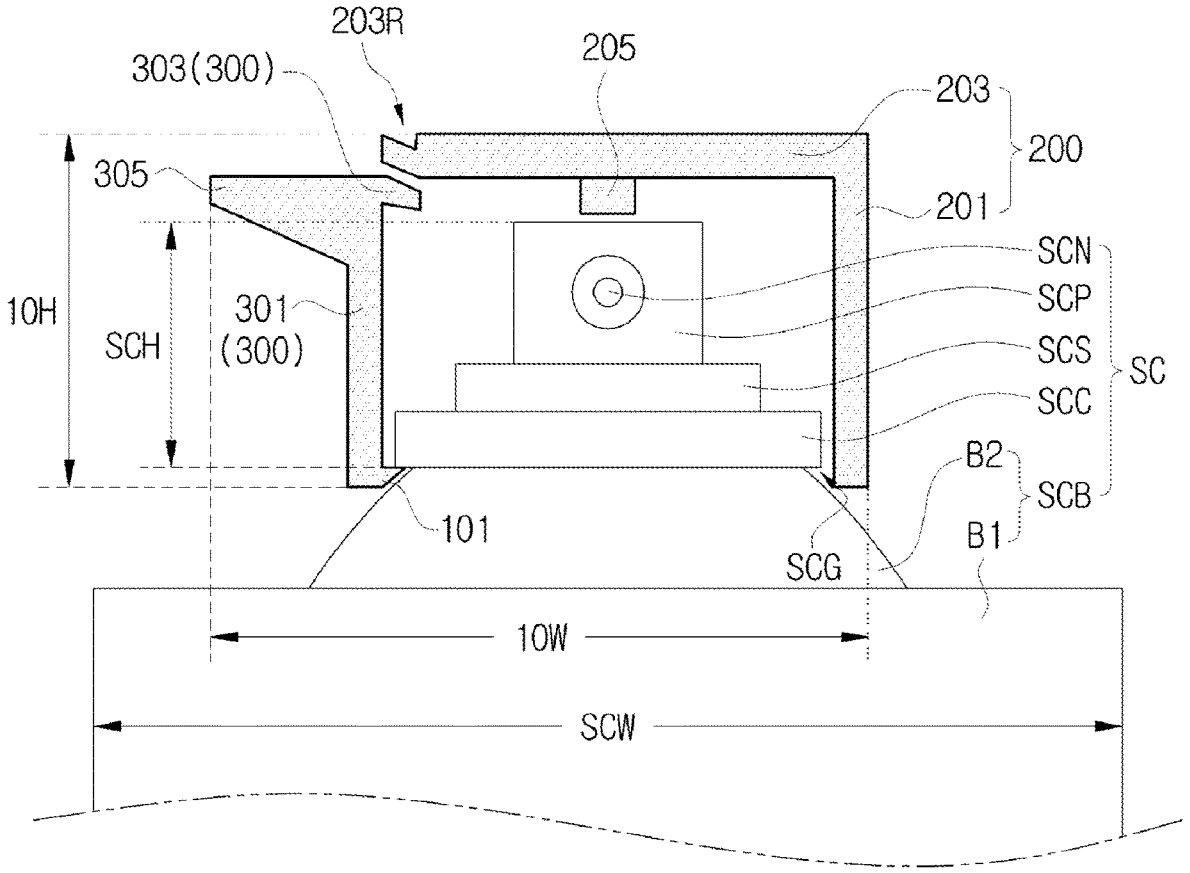
FIG. 3 shows a perspective view from bottom of the holding device of FIG. 1.

FIG. 2 shows a perspective view from above of the holding device 10 of FIG. 1 that is detached and apart from the top of the body SCB of the spray container SC. FIG. 3 shows a perspective view from bottom of the holding device of FIG. 1 that is detached and apart from the top of the body SCB of the spray container SC.

According to FIGS. 1, 2 and 3, the supporting part 100 may be loop-shaped and placed on a top of the body SCB of the spray container SC around the push button SCP. A top of the supporting part 100 may be lower than a top of the push button SCP. The supporting part 100 may be within the perimeter of the top of the body SCB. The supporting part 100 may comprise at least one inward protrusion 101, a fixing part, on the bottom. The inward protrusion 101 is constructed to engage with or disengage from a substantially annular groove SCG. The groove SCG is formed anywhere from the spray container body SCB to a nozzle part SCN of the spray can SC, and the groove SCG is fixed to the spray container SC. More specifically in this embodiment, the groove SCG may be formed between the body SCB and the coupling ring SCC as shown in the FIGS. 4 and 5. The location of the groove SCG in this embodiment is not limiting as to the location of the groove SCG in other embodiments.

As shown in FIGS. 2 and 3, the inward protrusion 101 lies below a bottom boundary of the supporting part, the bottom boundary of the support part being oriented towards the body SCB of the spray container SC when the holding device 10 is detachably coupled to the spray container SC. The supporting part 100 may include cuts 100D on the bottom in both sides of the inward protrusion 101. The cuts 100D on both sides of the inward protrusions 101 may allow the inward protrusions 101 to be opened, which makes it easier for the holding device 10 to engage with and disengage from the groove SCG of the spray container SC.

The adjusting part 200 has a pillar-shaped portion 201 standing on a top of the supporting part 100 and a diving board-shaped portion 203 connected to a top of the pillar-shaped portion 201. The diving board-shaped portion 203 may extend over a top of the push button SCP to contact with the push button SCP when the diving board-shaped portion 203 of the adjusting part 200 is pressed downward. The diving board-shaped portion 203 may include a recess 203R, a first interlocking part, on the top. The recess 203R may be formed an end of the diving board-shaped portion 203 but not limited to. The diving board-shaped portion 203 may include a contact area 205 on the bottom. The contact area 205 may be protruded toward the push button SCP. The contact area 205 contacts with the push button SCP when the diving board-shaped portion 203 is pressed downward.

The auxiliary part 300 may include a pillar-shaped portion 301 that is connected to the supporting part 100. The auxiliary part 300 may have an interlocking protrusion 303, a second interlocking part, extending toward the adjusting part 200. The interlocking protrusion 303 is to be engaged with the recess 203R when the diving board-shaped portion 203 is pressed downward to the extent that the recess 203R is located under the interlocking protrusion 303. The auxiliary part 300 may include an adjustment arm 305 protruded toward an outside of the supporting part 100. In other words, the adjustment arm 305 may protrude in an opposite direction to that of the interlocking protrusion 303, wherein the interlocking protrusion 303 is directed substantially inwardly towards a center of the holding device 10 as shown in FIG. 2.

As shown in FIG. 2, a first end of the pillar-shaped portion 301 is joined to the adjustment arm 305. A second end of the pillar-shaped portion 301 of the auxiliary part 300 is joined to one of the inward protrusion 101; the second end of the pillar-shaped portion 301 of the auxiliary part 300 lies opposite to the first end of the pillar-shaped portion 301 of the auxiliary part 300. Furthermore, the first and second ends of the pillar-shaped portion 301 are substantially similar in width. As shown, the cuts 100D about either sides of the inward protrusion 101 also help form part of the outer edges and the shape of the second end of the pillar-shaped portion 301. This construction of the pillar-shaped portion 301 together with the inward protrusion 101 allows the second end of the pillar-shaped portion 301 and the inward protrusion 101 to move in response to the movement of the first end of the pillar-shaped portion 301. Also shown in FIG. 2, the adjustment arm 305 is constructed and configured to be contiguous with at least one of the inward protrusions 101 such that movement of the adjustment arm 305 towards a center of the holding device 10 causes the inward protrusion 101 that is joined to the second end of the pillar-shaped portion 301 to move away from the center of the holding device 10; this movement allows the holding device 10 to engage to or disengage from the spray container SC. When the adjustment arm 305 is moved away from center, the inward protrusion 101 moves towards the center; this movement may result in the inward protrusion 101 engaging with the spray container SC if the holding device 10 is placed thereabouts.

Figure 4:
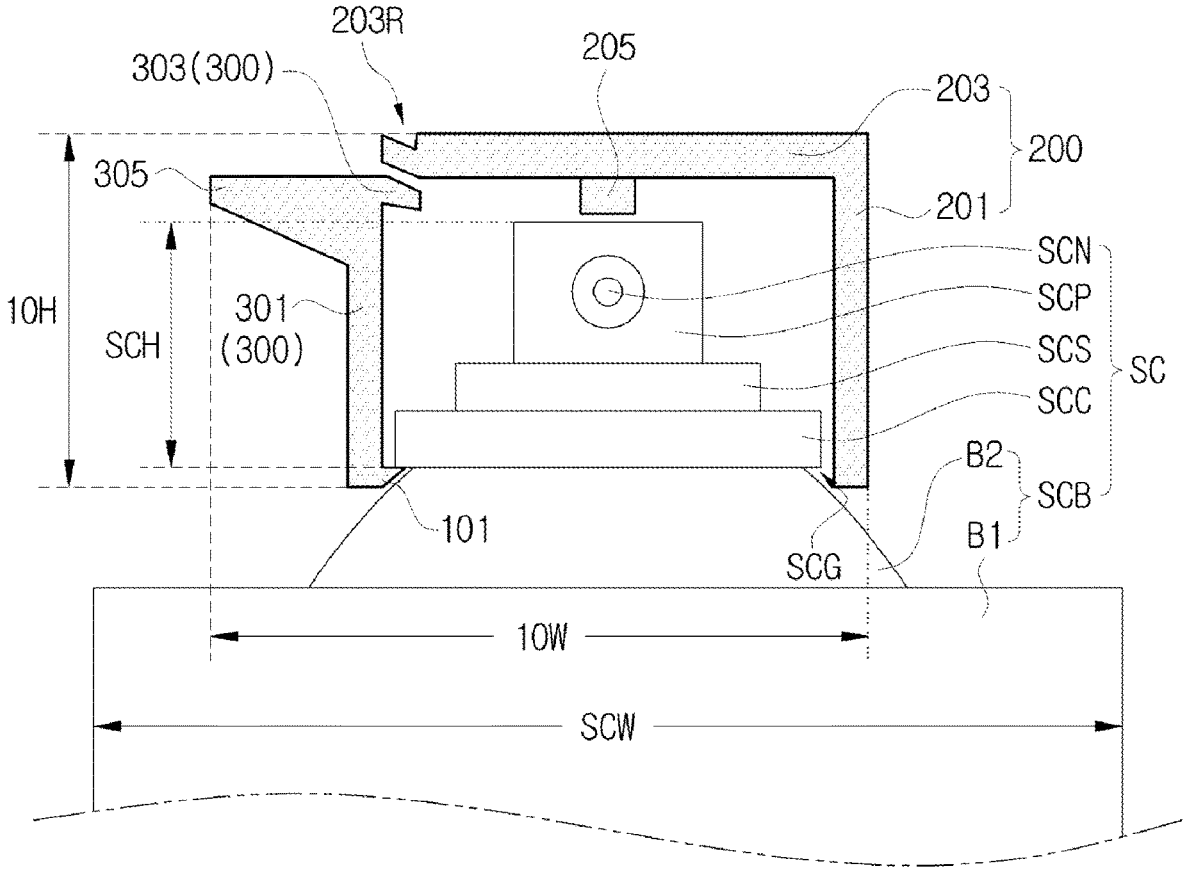
FIG. 4 shows a cross-sectional view of the holding device along line A-A of the FIG. 1.
Figure 5:
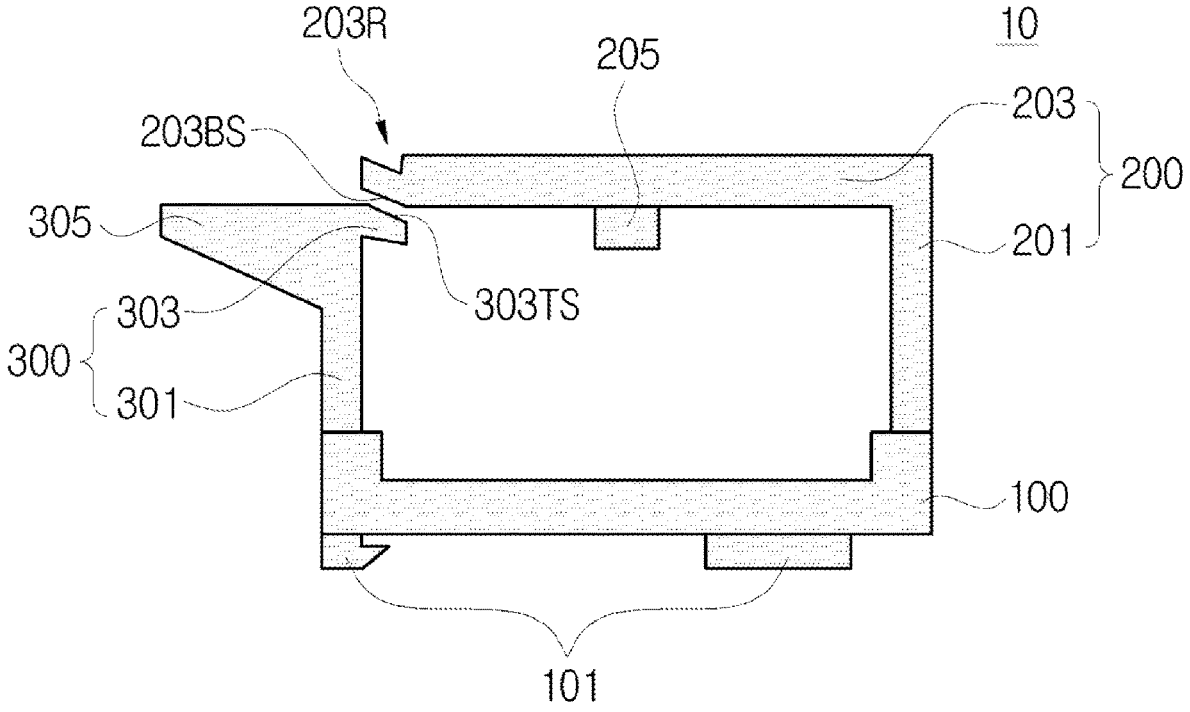
FIG. 5 shows a side view of the holding device of FIG. 2.
Figure 6:
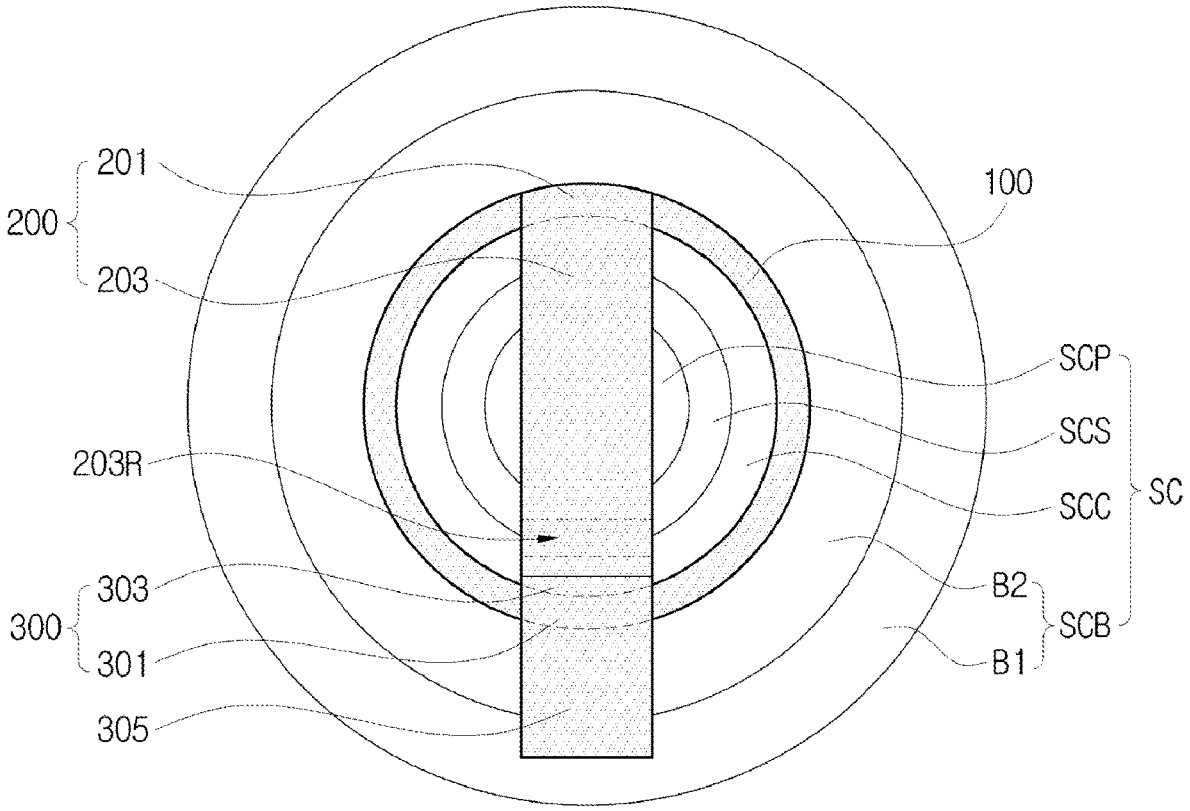
FIG. 6 shows a plan view of the holding device of FIG. 1.

As shown in FIGS. 1-3, the recess 203R and the interlocking protrusion 303 function as a first interlocking part and a second interlocking part respectively; however, the first interlocking part in the adjusting part 200 and the second interlocking part in the auxiliary part may have various structure to be engaged with each other. FIG. 4 shows a cross-sectional view of the holding device 10 along line A-A of the FIG. 2. FIG. 5 show a side view of the holding device 10 of FIGS. 2-3. FIG. 6 show a plan view of the holding device 10 of FIG. 1.

According to FIGS. 4-6, the holding device 10 is mounted on the spray container SC. The spray container SC may be one of commercial standard spray containers. The spray container SC may include a body SCB, a coupling ring SCC, a sealing ring SCS, and a push button SCP. The body SCB may comprise a first part B1 containing substance and a second part B2 for being connected to the coupling ring SCC. The second part B2 may be tapered to the top or dorm-shaped. The coupling ring SCC may connect between the second part B2 and the push button SCP. The sealing ring SCS may be located between the coupling ring SCC and the push button SCP. A groove SCG is formed along the circumference between the second body B2 and the coupling ring SCC.

The inward protrusions 101 on the bottom of the supporting part 100 are protruded toward inside of the supporting part 100. The inward protrusion 101 can engage with or disengage from the groove SCG, which makes the holding device 10 fixed to the spray container SC when the inward protrusion 101 is detachably coupled with the groove SCG. In the embodiment shown in FIGS. 1-3, the inward protrusion 101 functions as a fixing part, which makes the holding device 10 fixed to the spray container SC; however, the fixing part in other embodiments may have other structure other than the inward protrusion 101. In these alternative embodiments, the fixing part may be adhesive on the bottom of the supporting part 100 to make the holding device 10 is fixed to the spray container SC.

The supporting part 100 may be within the perimeter of the top of the body SCB. In addition, a width 10W of the holding device 10 may be equal to or lesser than that of the body SCW in a direction perpendicular to the push button pressed, in other words, in a X direction. Further, a height 10H of the holding device 10 may be lesser than twice a height SCH of a stack of the push button SCP, the sealing ring SCS, and the coupling ring SCC. According to the present invention, the holding device 10 is significantly downsized and light, which prevents an operator from suffering fatigue while also occupying minimal space.

The recess 203R formed on a top of the diving board-shaped portion 203 may be located in an end of the diving board-shaped portion 203 but not limited to.

A bottom side 203BS of an end of the diving board-shaped portion 203 and a top side 303TS of the interlocking protrusion 303 may be sloped. Sloped shapes of the bottom side 203BS and the top side 303TS make it easier for an operator to press the diving board-shaped portion 203 and make engagement between the recess 203R and the protrusion 303.

Figure 7:
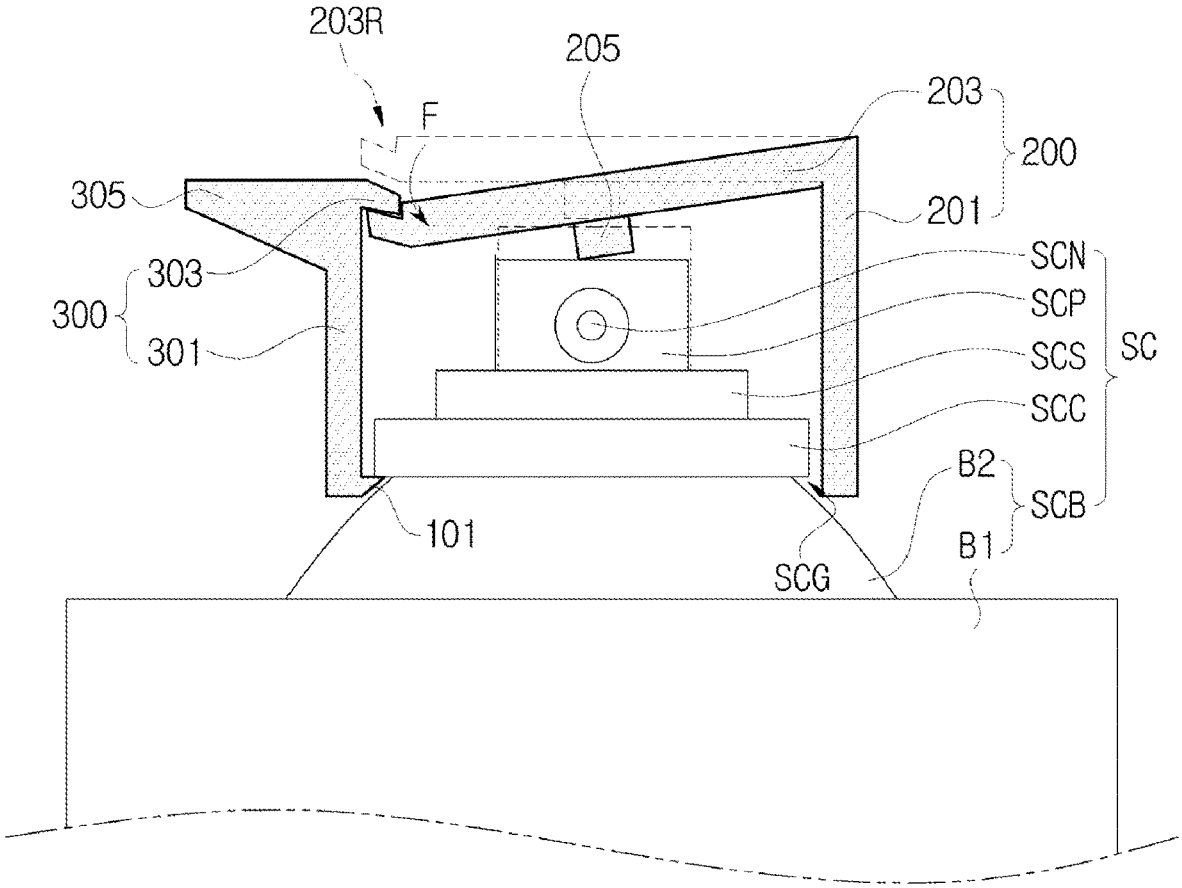
FIG. 7 shows a cross-sectional view of the holding device along line A-A of the FIG. 2 and a first position and a second position of the holding device.

FIG. 7 shows a cross-sectional view of the holding device 10 along line A-A of the FIG. 1 and a first position and a second position of the holding device. The first position is described in dotted lines, and the second position is described in solid lines. According to FIG. 7, the adjusting part 200 may have a first position which is an open state and a second position which is a closed state.

In the first position, the holding device 10 is mounted and fixed to the spray container SC, and the diving board-shaped portion 203 and/or the contact area 205 does not press the push button SCP. The recess 203R of the diving board-shaped portion 203 is located higher than the interlocking protrusion 303 of the auxiliary part 300 in a parallel direction of the push button pressed, in other words, in a Y direction. In the first position, the recess 203R and the interlocking protrusion 303 are not engaged with each other, and the spray container SC does not release the substance.

The second position may be made by a single click F on the diving board-shaped portion 203. Once an operator presses the diving board-shaped portion 203 downward until the recess 203R is engaged with the interlocking protrusion 303, the second position is maintained. The adjusting part 200 may be made of plastic but not limited to. Furthermore, in the second position, the recess 203R is located lower than the interlocking protrusion 303 in a Y direction. As the bottom of the diving board-shaped portion 203 or/and the contact area 205 press the push button SCP, the spray container keeps releasing the substance through nozzle SCN during the second position. In the second position, the holding device 10 causes the spray container SC to maintain a continuous release without a constant force of an operator. Accordingly, the holding device 10 on the spray container SC can prevent significant operator fatigue when the holding device 10 is used in the second position.

Figure 8A:
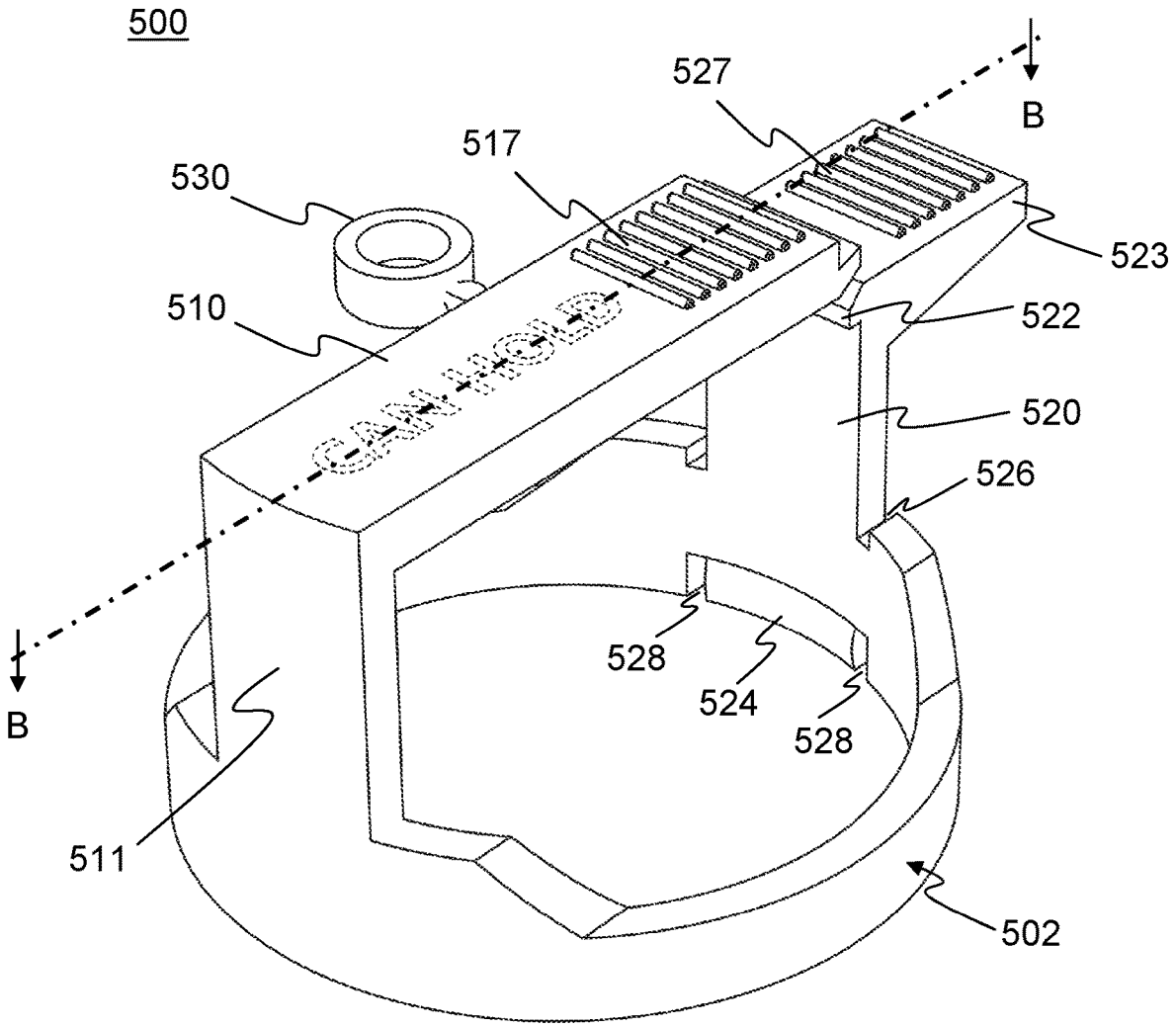
FIGS. 8A-D show perspective views of a holding device according to various embodiments of the present invention.
Figure 8B:
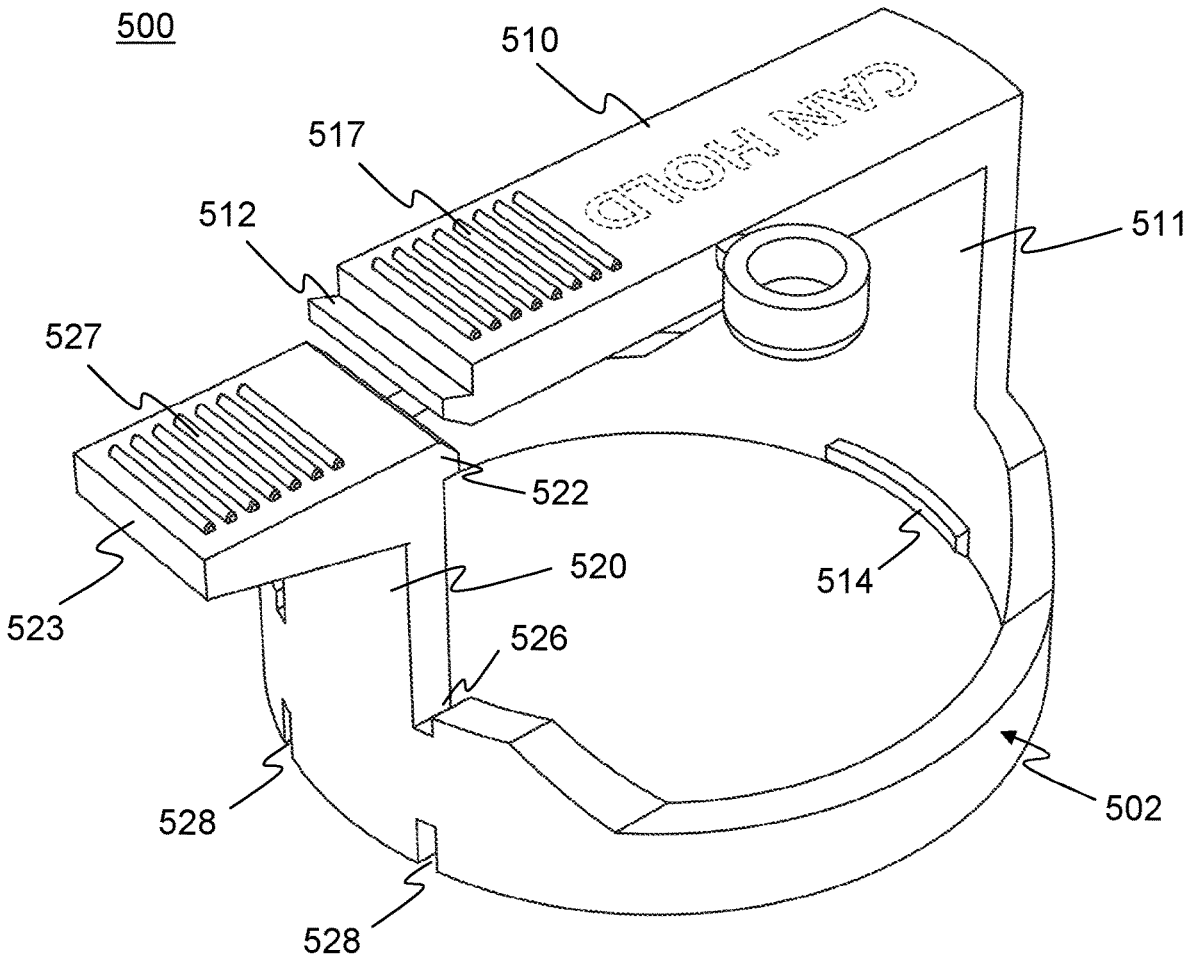
Figure 8C:
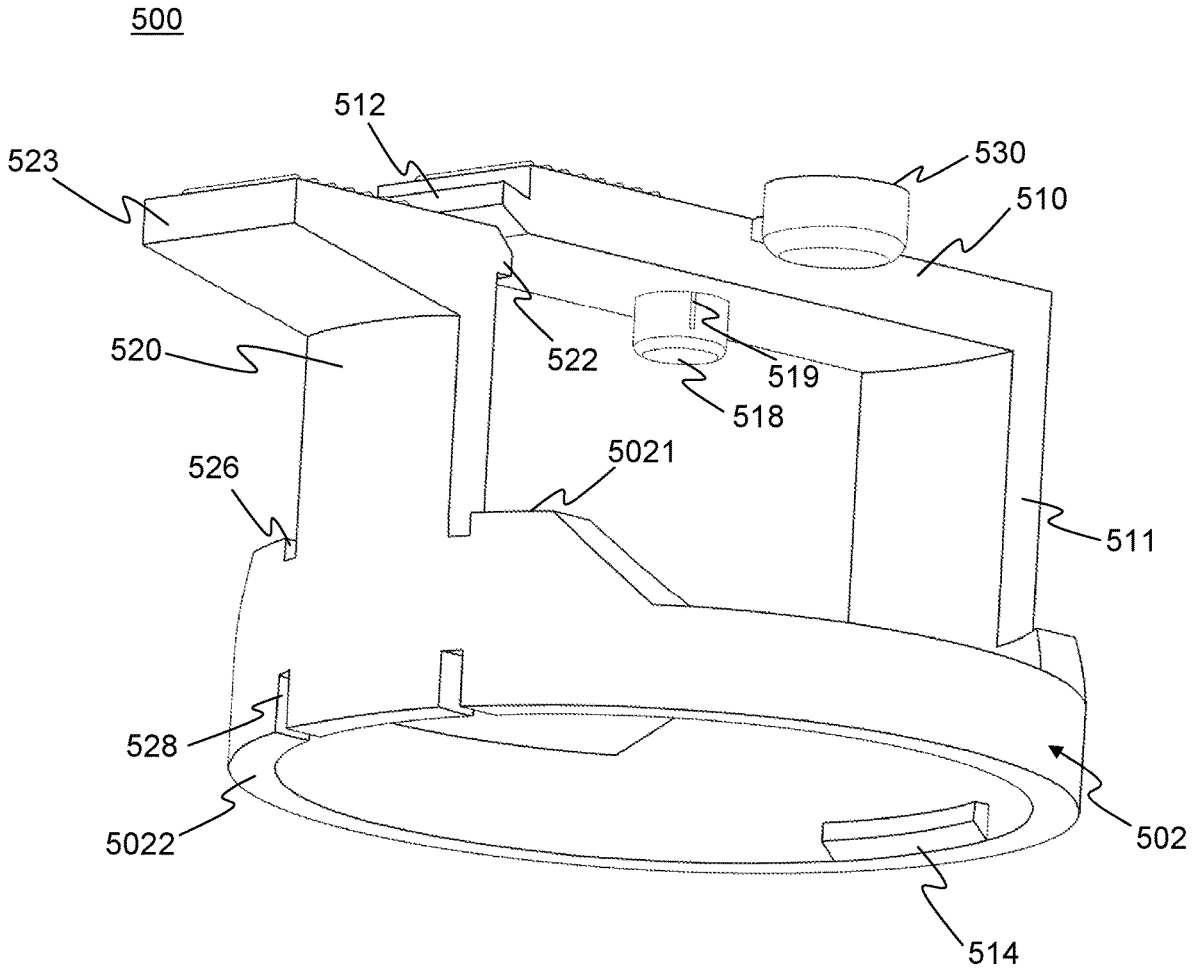

FIGS. 8A-C depict another embodiment of a holding device 500 for a spray container SC, the latter of which includes a body SCB, a nozzle portion SCN on a top of the body SCB, and a groove SCG formed between the body SCB and the nozzle portion SCN, the holding device 500 including a base 502, which is constructed to be placed on a top of the body SCB around the nozzle portion SCN; a pressing part 510 that is connected to a first portion of the base 502 and extends over the nozzle portion SCN, wherein an end of the pressing part 510 includes a first interlocking part 512; and a first supporting bar 520 which is connected to a second portion of the base 502, wherein a second interlocking part 522 is formed on or about a top of the first supporting bar 520 and a first protrusion 524 is inwardly formed on or about a bottom of the first supporting bar 520 to detachably couple with the groove SCG. The first portion of the base 502 preferably lies opposite to the second portion of the base 502 as shown. The first interlocking part 512 is constructed to be engaged with the second interlocking part 522 by downwardly moving the pressing part 510. Further, the first interlocking part 512 is constructed to be disengaged from the second interlocking part 522 by outwardly moving the first supporting bar 520. Also, the first protrusion 524 is constructed to be disengaged from the groove SCG by inwardly moving the first supporting bar 520, which moves the first protrusion outwardly apart from the groove SCG. The holding device 500 is made from an elastic material or thermoplastic elastomers like acrylonitrile butadiene styrene (ABS).

The holding device 500 further includes a second protrusion 514 as shown in FIG. 8B, which is inwardly formed to detachably couple with the groove SCG of the spray container SC. The second protrusion 514 is formed on or about a bottom of the pressing part 510. Additionally, the first and second protrusions 524, 514 are placed about or lower than a top edge 5021 of the base 502, and even may be placed lower than the base 502. As shown in FIGS. 8A and 8B, the first protrusion 524 is placed relatively below the second portion of the base 502 (due to the bottom cuts 528) and the second protrusion 514 is placed about the base 502. However, the second protrusion may be placed below the base 502 in a similar configuration as to the embodiment shown in FIG. 2.

The coupling strength between the second protrusion 514 and the groove SCG is preferably greater than a coupling strength between the first protrusion 524 and the groove SCG due to the differences in their respective shape profiles. The first protrusion 524 preferably adopts a convex shape for easy removal from the groove SCG and the second protrusion 514 is preferably substantially "L"-shaped that provides a greater coupling strength for the second protrusion 514. The first protrusion 524 and the second protrusion 514 are not limited by these shape profiles, as they can adopt any shape profile that does not depart from the spirit of this disclosure.

Figure 8D:
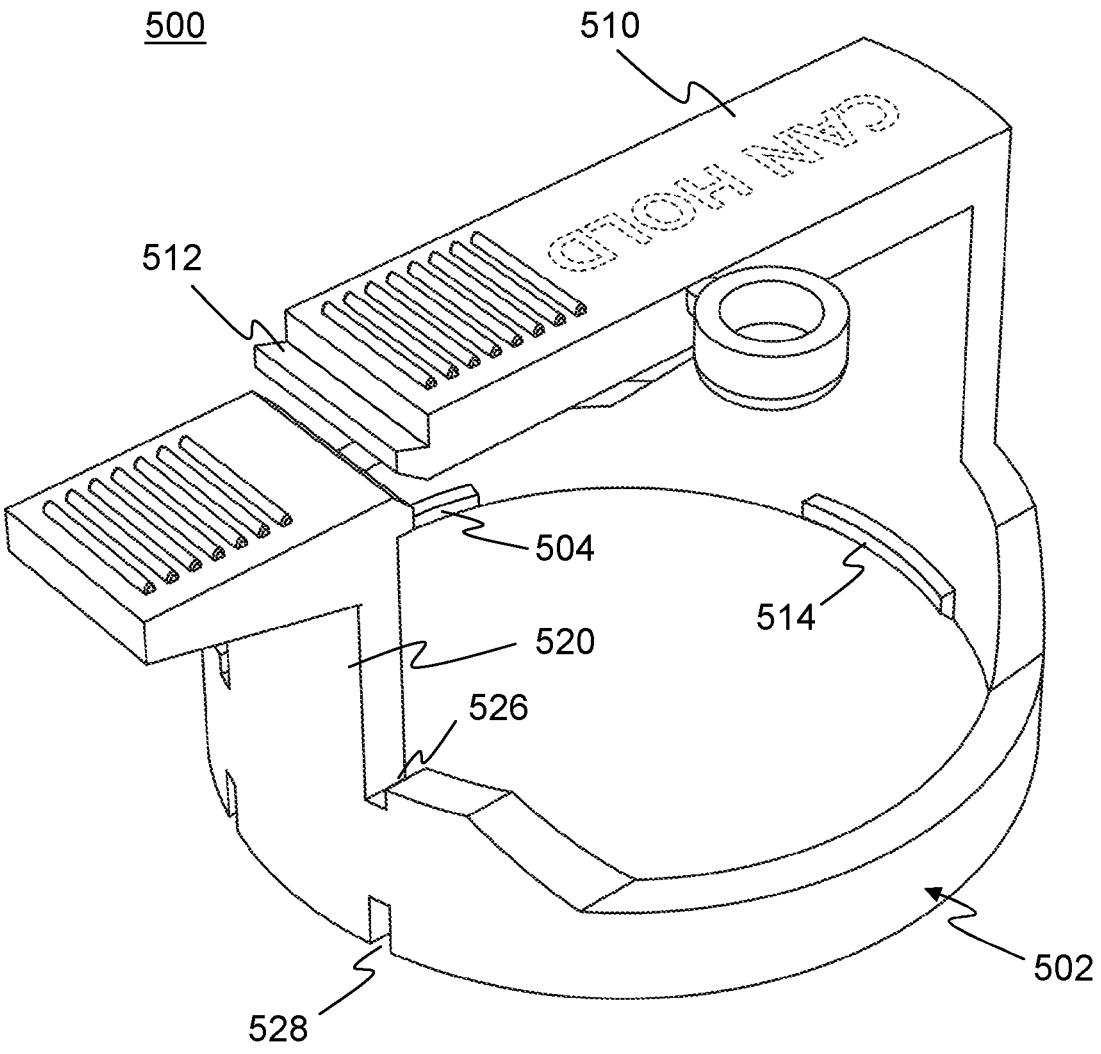

As shown in FIGS. 2 and 8D, the holding device 500 may further include a third protrusion 504 that is inwardly formed to detachably couple with the groove SCG. Further, the first, second, and third protrusions 524, 514, 504, are preferably formed at approximately 120° from each other. The coupling strength between the third protrusion 504 and the groove SCG is greater than the coupling strength between the first protrusion 524 and the groove SCG. The holding device may further include a fourth protrusion 544 that is inwardly formed to detachably couple with the groove SCG. Further, the first, second, third, and fourth protrusions 524, 514, 504, 544 are preferably formed at approximately 90° from each other. The coupling strength between the fourth protrusion 544 and the groove SCG is greater than the coupling strength between the first protrusion 524 and the groove SCG. In other words, the holding device may have n protrusions that are preferably spaced $$\frac{360^\circ}{n}$$

from each other.

Figure 9:
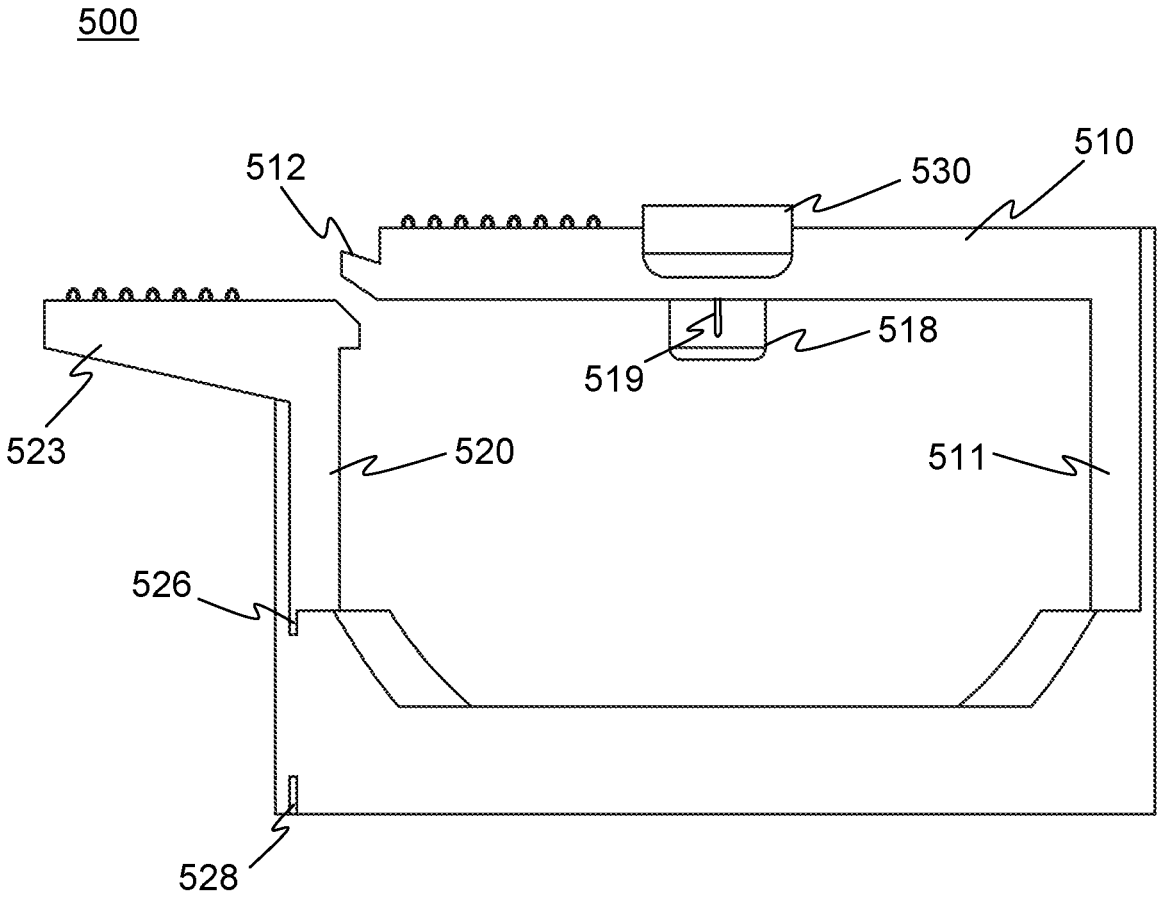
FIG. 9 shows a side view of the holding device according to various embodiments of the present invention.

The pressing part 510 further includes a protrusion 518 downwardly formed on a bottom of the pressing part 510. Similarly to the contact area 205 described above and shown in FIG. 7, the protrusion 518 of the pressing part 510 presses the nozzle portion SCN of the spray container SC when the first interlocking part 512 is engaged with the second interlocking part 522 and when the holding device 500 is detachably engaged with the spray container SC; in this arrangement, the release of the contents of the spray container SC (e.g. paint and the like) may be maintained continuously without the need for further user intervention, thus preventing user fatigue. Furthermore, the application of contents to surfaces or object may be applied evenly with this arrangement. Additionally, as shown in FIGS. 8C and 9, the protrusion 518 may have a ridge 519 running longitudinally as shown in FIGS. 8C and 9. The ridge 519 may provide an alternative aid in attaching and detaching of the extension part 530 to and from the protrusion 518 along with any frictional fit.

Figure 10:
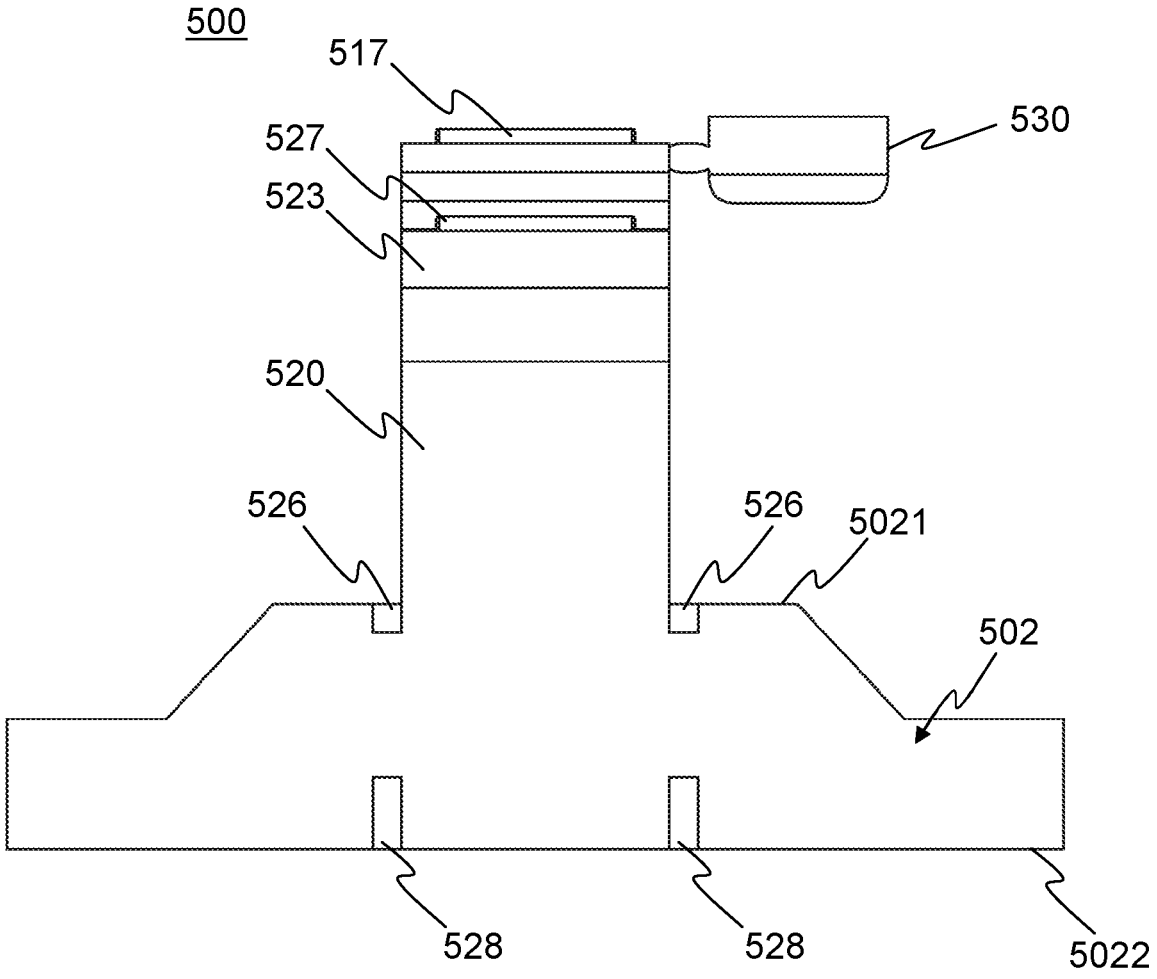
FIG. 10 shows a side view of the holding device according to various embodiments of the present invention.

As shown in FIGS. 8A-C and 9-11, the holding device 500 may further include an extension part 530. The extension part 530 is constructed to be detachably coupled to the holding device 500 as shown in FIG. 10. Furthermore, when detached, the extension part 530 is attachable to the protrusion 518 to increase a height of the protrusion 518 for nozzle portions SCN that are short in height. With regards to the protrusion 518, the protrusion 518 is preferably cylindrical and the extension part 530 is in a form of hollow cylinder that is closed at one end. The protrusion 518 is sized to be inserted into the extension part 530. Or, rather, when the extension part 530 is detached from the holding device 500, the user can fit the extension part 530 onto the protrusion 518. The protrusion 518 and the extension part 530 detachably attached to each other by friction fit.

As shown in FIGS. 8A-8C, the bottom cuts 528 and top cuts 526 are formed on the base 502 and on both sides of the first supporting bar 520. Specifically, the bottom cuts 528 are upwardly formed from a bottom edge 5022 of the base 502 and the top cuts 526 are downwardly formed from a top edge 5021 of the base 502 as shown. These top and bottom cuts 526, 528 permit the first supporting bar 520 to, at least partially, pivot about such that when the first supporting bar 520 is moved inwardly towards a center of the holding device 500, the first protrusion 524 moves outwardly. This outward movement of the first protrusion 524 may lead to the first protrusion 524 to be disengaged from the spray container groove SCG to decouple the holding device 500 from the spray container SC. Furthermore, the outward movement of the first protrusion 524 from the inward movement of the first supporting bar 520 may ease the process of coupling the first protrusion 524 into the spray container groove SCG. In this instance, the holding device 500 will be positioned such that the second protrusion 514 is secured in the groove SCG and the first protrusion 524 is about the groove SCG. That is until the release of the inwardly moved first supporting bar 520 causes the outward movement of the first supporting bar 520 and, as such, the inward movement of the first protrusion 524 into the groove SCG of the spray container SC, thus securing the holding device 500 to the spray container SC. To assist the inward movement of the first supporting bar 520, the first supporting bar 520 may include a tab 523 that is outwardly formed on or about the top of the first supporting bar 520 as shown in FIGS. 8A-C.

Figure 11:
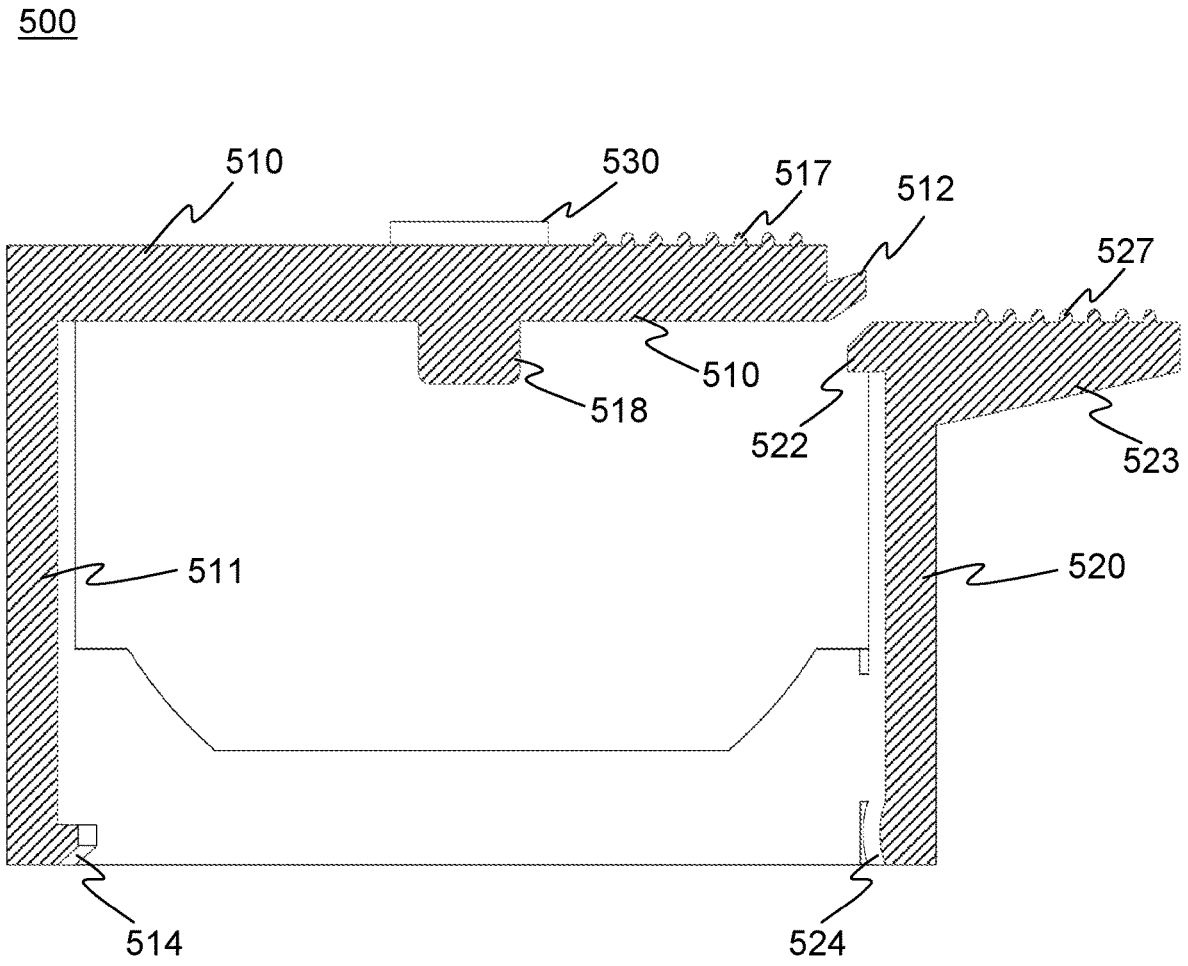
FIG. 11 shows a cross-sectional view of the holding device along line B-B of FIG. 8A.

Further aspects of the holding device 500 include the base 502 being substantially annular as shown. The base 502 is raised on both sides of the first supporting bar 520 to structurally reinforce the connection between the base 502 and the first supporting bar 520. This reinforcement is necessary to maintain structural integrity of the base 502 due to the top and bottom cuts 526, 528 into the base. Additionally, the pressing part 510 may further include a second supporting bar 511 that is connected to the first portion of the base 502, where the base 502 is raised on both sides of the second supporting bar 511 to structurally reinforce the connection between the base 502 and the second supporting bar 511. The second supporting bar 511 may include the second protrusion 514 as shown in FIGS. 8B-C and 11, where the second protrusion 514 is inwardly formed to detachably couple with the groove SCG similarly to the second protrusion 514 described above. Likewise, a coupling strength between the second protrusion 514 and the groove SCG is greater than a coupling strength between the first protrusion 524 and the groove SCG.

In this embodiment, and optionally in any embodiment hereinafter, the first supporting bar 520 and the pressing part 510 of the holding device 500 may further include first and second anti-slip means 527, 517 for increasing the amount of force (frictional and/or any other force) when the user's hand or finger touches or slides about certain portions of the first supporting bar 520 and the pressing part 510. In terms of increasing frictional force, the anti-slip means may be materials with higher coefficients of friction such as sandpaper, grip paper, artificial elastomers (e.g. synthetic rubber), thermoplastic elastomers, and the like. In terms of increasing the amount of force encountered on the surface of the first supporting bar 520 and the pressing part 510, the first and second anti-slip means 527, 517 may be protrusions formed on the respective surfaces of the first supporting bar 520 and the pressing part 510 as shown in FIG. 8A. Also shown, the first anti-slip means 527 is disposed on the tab 523 of the first supporting bar 520 and the second anti-slip means 517 is disposed near or about the first interlocking part 512 of the pressing part 510. Furthermore, the anti-slip means 527, 517 may be a combination of increasing frictional and static forces where the anti-slip means 527, 517 are protrusions as shown in FIG. 8A that are covered in material with higher coefficients of friction. This material may be applied directly via adhesives (during or after manufacturing) or via a spray deposition process during manufacturing. The anti-slip means 527, 517 provide greater control over the functioning of the holding device 500 when the holding device 500 is engaged with the spray container SC so that the dispensing of the contents from the spray container is easily controlled for even application of the spray contents to a desired target or object.

In another embodiment that is also represented by FIGS. 8A-C, a holding device 500 for a spray container SC which includes a body SCB, a nozzle portion SCN on a top of the body SCB, and a groove SCG formed between the body SCB and the nozzle portion SCN, the holding device 500 including a base 502, which is constructed to be placed on a top of the body SCB around the nozzle portion SCN; a pressing part 510 that is connected to a first portion of the base 502 and extends over the nozzle portion SCN, wherein an end of the pressing part 510 includes a first interlocking part 512; a first supporting bar 520 which is connected to a second portion of the base 502, wherein a second interlocking part 522 is inwardly formed on or about a top of the first supporting bar 520; a tab 523 that is outwardly formed on or about the top of the first supporting bar 520; and a first protrusion 524 inwardly formed to detachably couple with the groove SCG. The first portion of the base 502 preferably lies opposite to the second portion of the base 502 as shown. Also, the holding device 500 is made of an elastic material or a thermoplastic elastomer.

In this embodiment, the first interlocking part 512 is constructed to be engaged with the second interlocking part 522 by downwardly moving the pressing part 510. Further, the first interlocking part 512 is constructed to be disengaged from the second interlocking part 522 by downwardly moving the tab 523. Further, the first protrusion 524 is constructed to be disengaged from the groove SCG by upwardly or inwardly moving the tab 523.

The holding device 500 further includes a second protrusion 514 that is inwardly formed to detachably couple with the groove SCG of the spray container SC. Furthermore, a coupling strength between the second protrusion 514 and the groove SCG is greater than a coupling strength between the first protrusion 524 and the groove SCG. This difference in coupling strength is owed to the different shape profiles of the first protrusion 524 and the second protrusion 514, as the second protrusion 514 is constructed to tightly couple with the groove SCG of the spray container SC, whereas the first protrusion 524 is constructed to engage and disengage with the groove SCG to permit the holding device 500 to easily and straightforwardly couple with the SCG, and thus with the spray container SC.

Furthermore, the pressing part 510 further includes a protrusion 518 downwardly formed on a bottom of the pressing part 510 wherein the protrusion 518 presses the nozzle portion SCN when the first interlocking part 512 is engaged with the second interlocking part 522. The holding device 500 also features an extension part 530 that is constructed to be attachable to the protrusion 518 to increase a height of the protrusion 518 for nozzle portions SCN that are short in height. With regards to the protrusion 518 for this embodiment, the protrusion 518 shares a similar structure to the protrusion 518 disclosed in a previous embodiment, where the protrusion 518 here is preferably cylindrical and the extension part 530 is in a form of hollow cylinder that is closed at one end. The protrusion 518 is sized to be inserted into the extension part 530. Or, rather, when the extension part 530 is detached from the holding device 500, the user can fit the extension part 530 onto the protrusion 518. The protrusion 518 and the extension part 530 detachably attached to each other by friction fit.

In another embodiment, a holding device 500 for a spray container SC which includes a body SCB, a nozzle portion SCN on a top of the body SCB, and a groove SCG formed between the body SCB and the nozzle portion SCN, the holding device 500 including a base 502, which is constructed to be placed on a top of the body SCB around the nozzle portion SCN; a pressing part 510 that is connected to a first portion of the base 502 and extends over the nozzle portion SCN, wherein an end of the pressing part 510 includes a first interlocking part 512; a first supporting bar 520 which is connected to a second portion of the base 502, wherein a second interlocking part 522 is formed on or about a top of the first supporting bar 520; and a first protrusion 524 inwardly formed to detachably couple with the groove SCG. The first portion of the base 502 preferably lies opposite to the second portion of the base 502 as shown. Also, the holding device 500 is made of an elastic material or a thermoplastic elastomer.

For this embodiment, bottom cuts 528 are formed on the base 502 and on both sides of the first supporting bar 520 and the bottom cuts 528 are upwardly formed from a bottom edge 5022 of the base 502. The first interlocking part 512 is constructed to be engaged with the second interlocking part 522 by downwardly moving the pressing part 510. Further, the first interlocking part 512 is constructed to be disengaged from the second interlocking part 522 by outwardly moving the first supporting bar 520. Further, the first protrusion 524 is constructed to be disengaged from the groove SCG by inwardly moving the first supporting bar 520.

The holding device 500 of this embodiment further includes a second protrusion 514 which is inwardly formed to detachably couple with the groove SCG. Similarly to previously disclosed embodiments, a coupling strength between the second protrusion 514 and the groove SCG in this embodiment is greater than a coupling strength between the first protrusion 524 and the groove SCG. Similarly, the first protrusion 524 in this embodiment is constructed in a convex shape for easy removal from the groove SCG, and the second protrusion 514 is substantially "L"-shaped.

The pressing part 510 in this embodiment further includes a protrusion 518 downwardly formed on a bottom of the pressing part 510 wherein the protrusion 518 presses the nozzle portion SCN when the first interlocking part 512 is engaged with the second interlocking part 522. Also, the holding device 500 further includes an extension part 530 that is constructed to be attachable to the protrusion 518 to increase a height of the protrusion. The protrusion 518 is preferably cylindrical and the extension part 530 is in a form of hollow cylinder closed at one end. The protrusion 518 is sized to be inserted into the extension part 530 and be detachably attached to the extension part 530 by friction fit.

While the invention has been shown and described with reference to different embodiments thereof, it will be appreciated by those skilled in the art that variations in form, detail, compositions and operation my be made without departing from the spirit and scope of the invention as defined by the accompanying claims.

What is the claimed is:

1. A holding device for a spray container which includes a body, a nozzle portion on a top of the body, and a groove formed between the body and the nozzle portion, the holding device comprising:

a base, which is constructed to be placed on a top of the body around the nozzle portion;

a pressing part that is connected to a first portion of the base and extends over the nozzle portion, wherein an end of the pressing part includes a first interlocking part; and a first supporting bar which is connected to a second portion of the base, wherein a second interlocking part is formed on or about a top of the first supporting bar and a first protrusion is inwardly formed on or about a bottom of the first supporting bar to detachably couple with the groove, wherein the first interlocking part is constructed to be engaged with the second interlocking part by downwardly moving the pressing part, wherein the first interlocking part is constructed to be disengaged from the second interlocking part by outwardly moving the first supporting bar, and wherein the first protrusion is constructed to be disengaged from the groove by inwardly moving the first supporting bar.

2. The holding device of claim 1, further comprising a second protrusion which is inwardly formed to detachably couple with the groove, and wherein a coupling strength between the second protrusion and the groove is greater than a coupling strength between the first protrusion and the groove.

3. The holding device of claim 2, wherein the first protrusion is in a convex shape for easy removal from the groove.

4. The holding device of claim 3, wherein the second protrusion is substantially "L"-shaped.

5. The holding device of claim 3, wherein the second protrusion is formed on or about a bottom of the pressing part, and wherein the first and second protrusions are placed on or about the base.

6. The holding device of claim 1, further comprising a third protrusion which is inwardly formed to detachably couple with the groove, wherein a coupling strength between the third protrusion and the groove is greater than a coupling strength between the first protrusion and the groove, and wherein the first protrusion is in a convex shape for easy removal from the groove.

7. The holding device of claim 1, wherein the pressing part further includes a protrusion downwardly formed on a bottom of the pressing part wherein the protrusion presses the nozzle portion when the first interlocking part is engaged with the second interlocking part.

8. The holding device of claim 7, further comprising an extension part, wherein the extension part is constructed to be attachable to the protrusion to increase a height of the protrusion.

9. The holding device of claim 8, wherein the protrusion is cylindrical and the extension part is in a form of hollow cylinder closed at one end, wherein the protrusion is sized to be inserted into the extension part for being detachably attached to the extension part by friction fit.

10. The holding device of claim 1, wherein bottom cuts and top cuts are formed on the base and on both sides of the first supporting bar, and wherein the bottom cuts are upwardly formed from a bottom edge of the base and the top cuts are downwardly formed from a top edge of the base.

11. The holding device of claim 10, wherein the base is substantially annular, and wherein the base is raised on both sides of the first supporting bar for structurally reinforcing connection between the base and the first supporting bar.

12. The holding device of claim 11, wherein the pressing part further includes a second supporting bar which is connected to the first portion of the base, wherein the base is raised on both sides of the second supporting bar for structurally reinforcing connection between the base and the second supporting bar.

13. The holding device of claim 12, wherein the second supporting bar comprises a second protrusion which is inwardly formed to detachably couple with the groove, and wherein a coupling strength between the second protrusion and the groove is greater than a coupling strength between the first protrusion and the groove.

14. The holding device of claim 1, wherein the first supporting bar further includes a tab outwardly formed on or about the top of the first supporting bar.

15. A holding device for a spray container which includes a body, a nozzle portion on a top of the body, and a groove formed between the body and the nozzle portion, the holding device comprising:

a base, which is constructed to be placed on a top of the body around the nozzle portion;

a pressing part that is connected to a first portion of the base and extends over the nozzle portion, wherein an end of the pressing part includes a first interlocking part;

a first supporting bar which is connected to a second portion of the base, wherein a second interlocking part is inwardly formed on or about a top of the first supporting bar;

a tab that is outwardly formed on or about the top of the first supporting bar; and a first protrusion inwardly formed to detachably couple with the groove, wherein the first interlocking part is constructed to be engaged with the second interlocking part by downwardly moving the pressing part, wherein the first interlocking part is constructed to be disengaged from the second interlocking part by downwardly moving the tab, wherein the first protrusion is constructed to be disengaged from the groove by upwardly or inwardly moving the tab.

16. The holding device of claim 15, further comprising a second protrusion which is inwardly formed to detachably couple with the groove, and wherein a coupling strength between the second protrusion and the groove is greater than a coupling strength between the first protrusion and the groove.

17. The holding device of claim 15, wherein the pressing part further includes a protrusion downwardly formed on a bottom of the pressing part wherein the protrusion presses the nozzle portion when the first interlocking part is engaged with the second interlocking part, and wherein the holding device further comprises an extension part, wherein the extension part is constructed to be attachable to the protrusion to increase a height of the protrusion.

18. A holding device for a spray container which includes a body, a nozzle portion on a top of the body, and a groove formed between the body and the nozzle portion, the holding device comprising:

a base, which is constructed to be placed on a top of the body around the nozzle portion;

a pressing part that is connected to a first portion of the base and extends over the nozzle portion, wherein an end of the pressing part includes a first interlocking part;

a first supporting bar which is connected to a second portion of the base, wherein a second interlocking part is formed on or about a top of the first supporting bar; and a first protrusion inwardly formed to detachably couple with the groove, wherein bottom cuts are formed on the base and on both sides of the first supporting bar and the bottom cuts are upwardly formed from a bottom edge of the base, wherein the first interlocking part is constructed to be engaged with the second interlocking part by downwardly moving the pressing part, wherein the first interlocking part is constructed to be disengaged from the second interlocking part by outwardly moving the first supporting bar, wherein the first protrusion is constructed to be disengaged from the groove by inwardly moving the first supporting bar.

19. The holding device of claim 18, further comprising a second protrusion which is inwardly formed to detachably couple with the groove, wherein a coupling strength between the second protrusion and the groove is greater than a coupling strength between the first protrusion and the groove, wherein the first protrusion is in a convex shape for easy removal from the groove, and wherein the second protrusion is substantially "L"-shaped.

20. The holding device of claim 18, wherein the pressing part further includes a protrusion downwardly formed on a bottom of the pressing part wherein the protrusion presses the nozzle portion when the first interlocking part is engaged with the second interlocking part, wherein the holding device further comprises an extension part, wherein the extension part is constructed to be attachable to the protrusion to increase a height of the protrusion, wherein the protrusion is cylindrical and the extension part is in a form of hollow cylinder closed at one end, and wherein the protrusion is sized to be inserted into the extension part for being detachably attached to the extension part by friction fit.

* * * * *